United States Patent [19]

DeHaitre

[11] 4,403,126

[45] Sep. 6, 1983

[54] DUAL-INLINE SCREW-SWITCH ASSEMBLY

[75] Inventor: Lon DeHaitre, Arlington Heights, Ill.

[73] Assignee: Abbott-Interfast Corporation, Wheeling, Ill.

[21] Appl. No.: 331,235

[22] Filed: Dec. 16, 1981

[51] Int. Cl.[3] ..... H01H 1/20

[52] U.S. Cl. ..... 200/158; 200/243; 200/16 R

[58] Field of Search ..... 200/243, 158, 16 R

[56] References Cited

U.S. PATENT DOCUMENTS

| | | | |
|---|---|---|---|
| 2,854,552 | 9/1958 | Gouverneur | 200/158 |
| 4,004,119 | 1/1977 | Latour | 200/158 |
| 4,027,128 | 5/1977 | Walker | 200/158 |

FOREIGN PATENT DOCUMENTS

| | | | |
|---|---|---|---|
| 700496 | 12/1953 | Canada | 200/293 |

*Primary Examiner*—John W. Shepperd
*Assistant Examiner*—Renee Kidorf
*Attorney, Agent, or Firm*—Silverman, Cass & Singer, Ltd.

[57] ABSTRACT

A screw-switch assembly for use in place of present Dual-Inline-Package (DIP) slide-or snap-action switch assemblies is disclosed. An insulative body is molded to form a strip of joined segments arranged side-by-side, each segment constituting a single, independent switch having two poles and a single bridging contact member in the form of a screw head. The segments provide two passageways opening to both the top surface and the bottom surface of the segment and a socket opening to at least the top surface of the segment adjacent alternating passageways in sequential segments. A headed stake is inserted through the passageway of each segment adjacent the socket and a bent stake is inserted through the other passageway of each segment. The top portions of the stakes of each segment are formed to provide electrical contact surfaces adjacent the socket of that segment. The bottom portions of the stakes extend beyond the bottom surface of the segment for mounting in a printed circuit board. A headed screw is threadedly inserted in each socket and, when screwed home, the head makes electrical contact across the two stakes to close the switch and, when backed off, the head is spaced from the stakes to open the switch. Two connecting webs are formed between pairs of adjacent segments, one at each end of the segments. Blocks of desired numbers of switches are separated from the assembly by cutting through both of the connecting webs between a pair of adjacent segments, the remainder of the connective webs remaining intact.

30 Claims, 5 Drawing Figures

FIG. 1
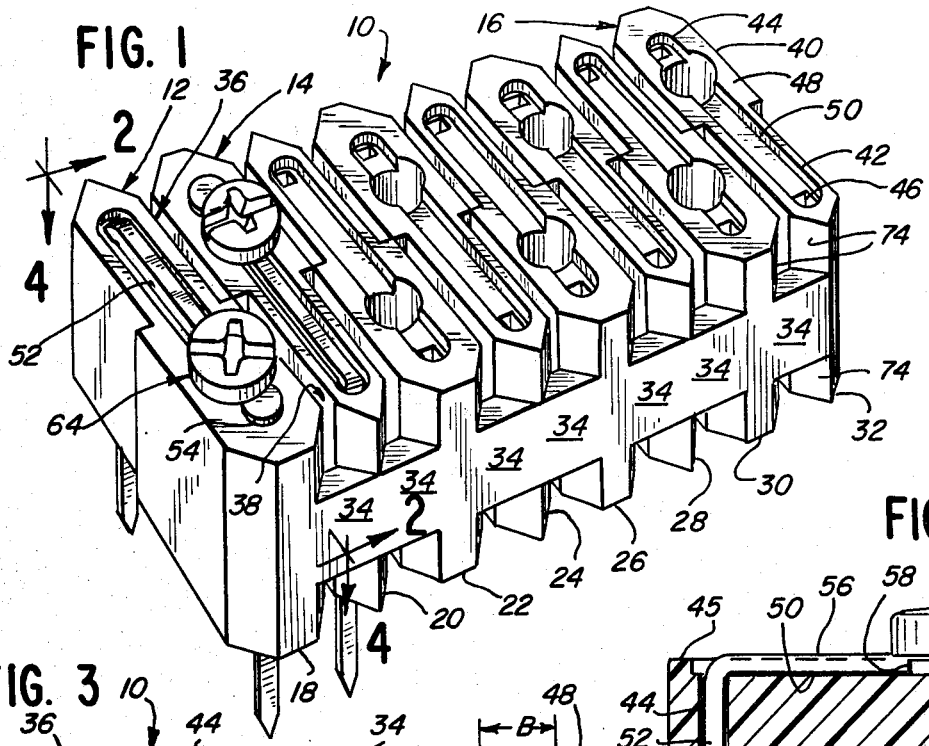
FIG. 2
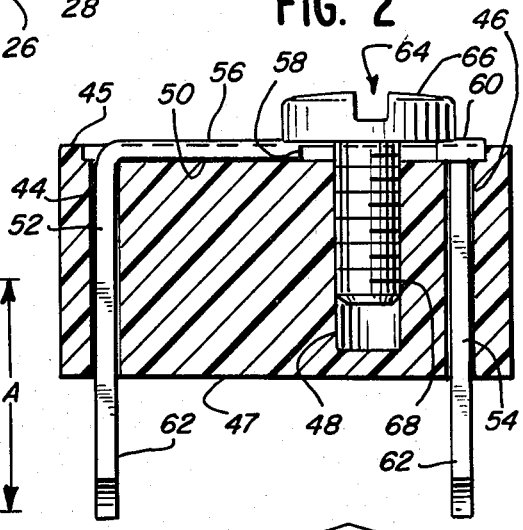
FIG. 3
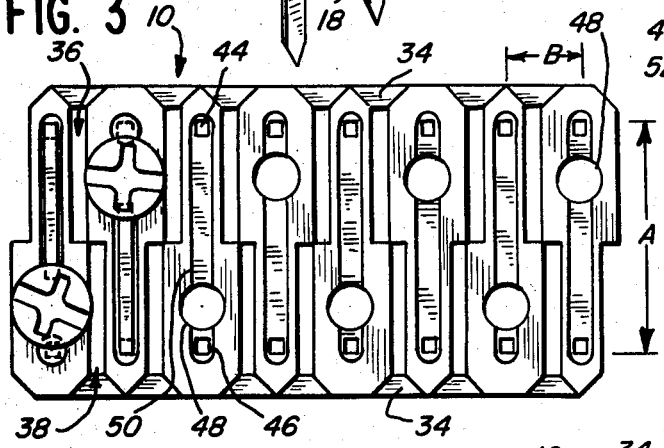
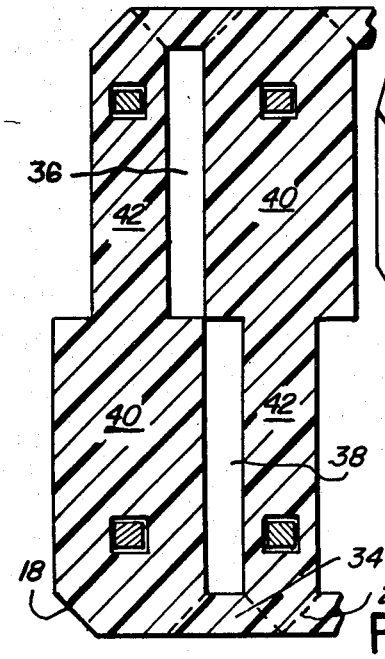
FIG. 4
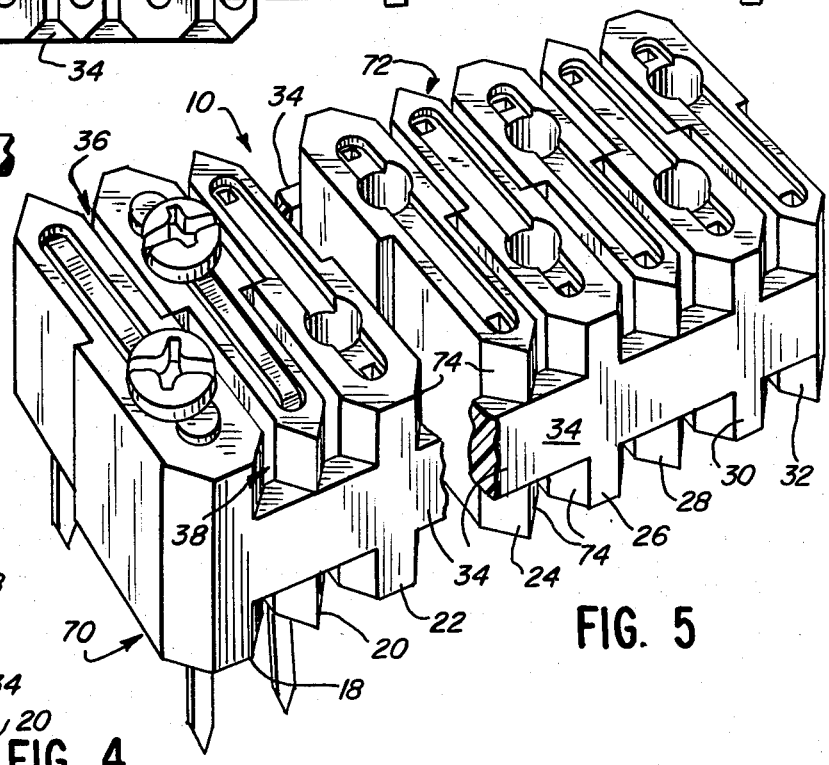
FIG. 5

DUAL-INLINE SCREW-SWITCH ASSEMBLY

BACKGROUND OF THE INVENTION

This invention relates to electrical switches generally and, in particular, relates to miniature electrical switches used in electronic circuits comprising components which are mounted by their leads on printed circuit boards.

Modern electronic circuits often provide switch selectable options to perform several functions. Selection of these options is made by factory or field personnel setting or resetting small or miniature switches mounted on circuit boards by their leads. In operation, these switches are much like conventional two-position switches in that in one position they close a circuit and in the other position they open the circuit. In structure, however, the switches are much smaller than conventional switches and thus they require minimum areas on the circuit boards, and adjacent circuit boards on which they are mounted may be closely spaced from one another. The switches include contacts which are designed to carry low level logic currents between logical elements such as transistors and integrated circuits.

The miniature switches usually are set in one position or the other and remain in that position during the operational life of the circuit board or related equipment in which they are installed, but occasionally are actuated to the opposite position to re-select the desired option.

These switches generally are of two types. The first type of switch is essentially a scaled-down wall switch. It is formed in an assembly resembling an integrated circuit and has switch leads arranged in two rows along the bottom of the assembly spaced from one another at the same standard distances designated for integrated circuit leads. This type of switch assembly, also known as a Dual-Inline-Package switch assembly or DIP-switch assembly comprises a plurality of slide- or snap-action contact switches arranged laterally across the assembly with the two leads of each switch being arranged opposite one another. Each switch includes either a button which is reciprocated rectilinearly to actuate the slide contacts or a toggle arm which is reciprocated about a pivot to actuate spring-loaded snap contacts. Typically, such a DIP-switch assembly is designed to have the same dimensions as an integrated circuit package to facilitate printed circuit board layout and increase the circuit board component density. The main advantage of DIP-switches is the high switch density they provide.

There are several problems with such DIP-switch assemblies. The first is that the number of parts necessary to fabricate each switch of the assembly is excessive. Each snap-action switch typically includes a lower body portion, two contact-lead members, a toggle arm, a pivot pin, a detent member, a spring, a ball bearing, a piece of tape to separate the contact members from contaminants and an upper body portion. Optionally, a conductive grease is applied to the contact members and often the whole assembly is potted or molded with a potting compound.

The number of parts varies with different designs, but to assemble one eight switch assembly, approximately 60 individual parts must be handled in an assembly process that does not normally lend itself to mass production techniques. These are small parts which are difficult to handle and which must be precision manufactured.

A second problem with DIP-switch assemblies is the inadvertent setting or resetting of individual switches when the switch assembly is mounted on a printed circuit board. This can occur by action of vibration or by the hand or cuff of a technician or user inadvertently engaging the toggle arm of a snap-action switch and setting or resetting a switch to the opposite position intended. When this occurs, a technician who has been trained to understand the option selection settings is required properly to place the toggle arm in its correct position. This problem is not as prevalent with slide-action switches where the buttons are closer to the switch body than the toggle arms, and further to reduce the possibility of this problem, the buttons are protected by an additional member known as an overcover overlaid on top of the slide-action switch assembly.

A third problem with DIP-switches is that high resistance coatings can form on the switch contacts and result in a high resistance therebetween even when the switch contacts are closed, providing an incorrect logic level in the electronic circuit. These high resistance coatings are formed by contaminants such as airborne pollutants, circuit board manufacturing chemicals and even elimination products from the potting compound joining together the parts of the switch assembly. Logic level currents of typically several milliampers are normally insufficient at logic level voltages to break through these coatings.

An example of such airborne pollutants is the oil thrown into the air by the electro-mechanical equipment in which such DIP-switches are used. This airborne oil coats all of the components of the equipment with a fine, oily film and can migrate between the parts of the DIP-switch assembly to the contacts to form the described coatings. In manufacturing, solvents are used to clean assembled circuit boards and their components. When these solvents evaporate, they can leave solid residues on the contacts which form the described coatings. This problem has been reduced by placing a strip of tape over the switch contacts to reduce the migration of contaminants to the switch contacts, but this has not eliminated the problem.

A fourth problem with DIP-switches is that their applications are limited to switching logic level signals of typically several milliamperes at approximately five volts. They are not recommended for carrying power currents of typically hundreds of milliamperes at approximately 24 volts. This is because the DIP-switch contacts are designed to be small so that they may be accommodated in an assembly having the same dimensions as an integrated circuit. This results in the contact area being small and the current density being high. At power current levels, the high current density can result in the contacts burning out. The problem of contact burnout is avoided by not using DIP-switches to carry or switch power currents.

A fifth problem with DIP-switches is that they are commercially available only in assemblies of standard numbers of switches, such as four, eight, ten or twelve. A DIP-switch assembly of such as nine switches is not commercially available except upon special order and substantially increased price. Thus, a manufacturer having a circuit requiring a DIP-switch assembly of some number of switches other than standard must select an available assembly having a greater number of switches than is required and not use the additional switch or switches, which is wasteful. This waste becomes significant when large numbers of switch assemblies are used.

These problems, generally, have not been eliminated in the highly developed DIP-switches currently available, but simply are tolerated. The development of these DIP-switches, which has occurred over a long period and which recently has stagnated, has not addressed the fundamental reasons for these problems but has only reduced the severity of the problems, with attendant increase in the cost and complexity of such switches. Essentially, the present DIP-switches are highly developed, but scaled down, wall switches. But because of the high switch component density which they provide, DIP-switches are used in large numbers over other types of switches.

The second type of switch is a screw-type of switch and is well-known. A perforation is made through the printed circuit board and a front conductor is printed about the perforation on the front side of the board while a rear conductor is printed about the perforation on the rear side of the board. A nut is swaged and soldered in place on the rear side of the board in contact with the rear conductor, with the threaded opening of the nut axially centered with the perforation. A screw then is threaded through the perforation and into the nut so that its head is engageable against the front conductor. The screw-switch thus formed between the front and rear conductors may be closed by screwing home the screw into the nut to engage the head against the front conductor and may be opened by backing off the screw from the nut to disengage the head from the front conductor.

Screw-switches also present problems. The first is that they require too much area on the printed circuit board. The nuts and screws typically are large to expedite the mechanical operations of swaging the nut on the rear of the board and threading the screw into the nut. The designs of different screw-switches require different areas, but in one design, one screw-switch requires approximately the same area as an assembly of four DIP-switches. Component density must be maintained high on circuit boards to realize cost savings, and the more area required for switches lowers the component density and increases the cost.

A second problem is maintaining the screw head disengaged from the front conductor but threaded in the nut. Simple vibration can rotate the screw while loosened so that either the head engages the front conductor to close the switch, or the screw becomes unthreaded from the nut and falls from the board into other electronic circuitry. Either event is undesirable. Attempts to solve this problem include designing a special screw with an unthreaded, smaller diameter shank portion in the shaft so that the screw must be positively threaded past the shank portion for either tightening the screw into the nut or removing the screw from the nut and board. Another solution provides a removable insulator mounted on the screw shaft to separate the front conductor and screw head and maintain the switch open even when the screw is tightened into the nut. A third solution provides means in the nut which hold the screw in any rotational position under vibrational force, but which provides for rotation of the screw under a greater, intentionally applied force. All of these attempted solutions require specially designed parts.

A third problem is the manual labor required to assemble a nut and screw screw-switch on a board. The swaging of the nut on the board and the threading of the screw into the nut are normally manual operations which are not readily automated. One attempted solution is to provide an assembly providing a single screw-switch assembly which may be mounted on a board by its two depending leads. This solution simplifies the assembly of new boards laid-out to accommodate such an assembly, but this assembly cannot be retro-fitted into existing boards having a screw-switch assembly. Further, this single screw-switch assembly requires as much board area as a conventional screw-switch.

For these reasons, screw-switches have been used in small numbers and then mainly in single station applications where, for example, the switch contacts carry a power level current to such as the coil of a solenoid. Thus, while DIP-switches and screw-switches are used for similar and often the same applications, DIP-switches have been used much more extensively because of the higher switch density they provide.

What is desired is a switch assembly which may be retrofitted into the DIP-switch assembly layouts of existing boards and which maintains the switch density which a DIP-switch assembly presently provides, but which avoids or eliminates the problems accompanying DIP-switches.

SUMMARY OF THE INVENTION

In accordance with the invention, there is provided a novel and simple assembly of positive action screw-switches arranged in a strip which can handle both logic level and power level currents free of pollution contamination of the switch contacts in a standard-dimensioned, miniature-electronic configuration. Additionally, the invention provides for ready separation of such switches, one from another, so that blocks of desired numbers of such switches may be formed.

The invention provides an assembly of integrally formed, joined segments of insulating material molded in strip form side by side and capable of being separated into blocks of desired number of segments, each segment constituting a single independent switch having two poles and a single bridging contact member in the form of a screw, the screw-head forming the electrically bridging part.

Each segment has a pair of passageways passing through the same at opposite ends thereof, the passageways being parallel and spaced apart by a standard distance. Each segment has an upper surface and a lower surface, the passageways opening to the respective upper and lower surfaces. Each segment also is provided with a vertically extending socket which opens to the upper surface and is located adjacent the upper end of one of the passageways, the socket of each segment being located adjacent alternate passageways so that the sockets are in effect opposite one another in adjacent segments.

Each passageway has a metal conductive stake installed therein and extending completely through the passageway, there being a bottom pointed end which protrudes beyond the bottom surface of the segment and a top end which serves as a contact or pole of the double pole switch formed by each segment. Thus, there are two such stakes for each segment, the bottom ends of which are similar. The top ends of each pair of stakes are different from one another. That stake which emerges adjacent a socket is headed at that location while the other stake has an extension which is bent over and fitted in the top surface of the segment with its free end spaced slightly from the socket.

The upper ends of the stakes, comprising the bent over end of one and the headed end of the other, protrude slightly above the plane of the upper surface of the segment. A screw having a head with a flat undersurface is threadedly engaged in each socket and the spacing of the stake head and free end of the bent stake of each segment is such that when the screw head is tightened toward the upper surface of that segment it will make electrical contacting engagement with and bridge the pair of stakes. When loosened, it will open the electrical circuit into which the stakes are connected, rising above the stake ends.

The screw has threads which form mating threads in the wall of the socket. The material of the segment is such that the formed threads engage the screw threads tightly so that the screw may be rotated only under an intentional, rotative force applied thereto. The material of the segment also is such that if the formed threads are stripped by over-tightening of the screw, the screw may be reinserted in the socket to form new mating threads with little or no loss of ability to tighten the screw in the socket.

The segments are joined together at their ends by connecting webs integrally molded with the segments. The connecting webs are formed so that there are two such webs between adjacent segments, one at either end of the segments. The connecting webs are arranged in two longitudinal rows, one row extending along each side of the strip of segments about the horizontal median plane thereof. Each web has a height less than the distance between the segment top and bottom surfaces and a width much less than the distance between the segment sides. The length of each web is determined by the clear distance between segments.

Blocks of desired numbers of segments are formed by cutting through the two connecting webs joining two adjacent segments. This separates those two segments from one another, while the connecting webs between the other segments of each block remain intact. The sides of the segments above and below the rows of connecting webs are beveled inwardly to facilitate the entrance of the blades of a cutting tool therebetween for cutting through the connecting webs.

BRIEF DESCRIPTION OF THE DRAWING

FIG. 1 is a perspective view of a DUAL-IN-LINE screw-switch assembly constructed and arranged in accordance with the invention;

FIG. 2 is a sectional view of the screw-switch assembly taken along the lines 2—2 of FIG. 1 and in the direction indicated by the arrows;

FIG. 3 is a plan view of the screw-switch assembly illustrated in FIG. 1;

FIG. 4 is a partial sectional view of the screw-switch assembly taken along the lines 4—4 of FIG. 1 and in the direction indicated by the arrows; and FIG. 5 is a perspective view of the screw-switch assembly illustrating connecting webs between segments which are cut through to obtain blocks of desired numbers of switches.

DESCRIPTION OF THE PREFERRED EMBODIMENT

The invention provides a screw-switch assembly which is a direct replacement for DIP-switch assemblies and which exhibits superior characteristics.

In the drawing, there is illustrated an assembly 10 providing eight individual switches, of which, only two switches 12 and 14 are shown fully assembled. Assembly 10 comprises a body 16 providing a strip of eight individual segments 18 through 32, integrally molded together by the intermediaries of thin connecting webs 34. The segments 18–32 are arranged in side-by-side alignment and are separated from one another by alternating voids such as at 36 and 38. Thus, the only structure joining the segments together are the connecting webs.

Connecting webs 34 are formed so that there are two such webs between each pair of adjacent segments, one at either end of the segments. The webs are axially aligned in two longitudinal rows, one row extending along each side of the strip of segments, about the horizontal median plane of the segments. Each web has a height less than the distance between the top and bottom surfaces of the segments and a width which is much less than the distance between the segment sides. The length of each web is approximately the distance between segments.

Each segment includes a thick portion 40 and a thin portion 42 arranged to be in alternating positions in sequential segments, as is best seen in FIG. 4. The body 16 is formed by precision injection molding of an insulative thermo-plastic material, such as polyester. The principal requirements of such material are that it be electrically insulative, that it be readily injection molded in a precision molding process, that it be able to maintain its shape in an electronic component environment, and that it be able to accept a self-threading screw. An example of such material is the material sold by the DUPONT CO. under the trade name of Zytel ST 801.

Each switch of the assembly 10 is comprised of one segment, one screw, one bent stake and one headed stake.

Each segment is provided with two vertically extending and parallel passageways 44 and 46 extending from the top surface 45 to the bottom surface 47 of the segment. The passageways are at opposite ends of each segment and are arranged substantially in two rows along the strip. The passageways in each segment are spaced apart by a distance A (FIG. 3), which is approximately 0.300 inches; while the passageways in adjacent segments are spaced apart by a distance B of approximately 0.100 inches. These distances are the standard distances for spacings between leads of integrated circuits and DIP-switches.

The segments additionally are provided in their thick portions 40 with vertically extending sockets 48. The sockets 48 are open at least to the top of each segment and are arranged adjacent alternating ones of the passageways in adjacent segments. Each segment additionally is provided with a slot 50 in the top thereof. The slot 50 extends from beyond passageway 44 to beyond passageway 46.

One bent stake 52 and one headed stake 54 are inserted, respectively, into the passageways 44 and 46. The stakes 52 and 54 include respective top and bottom portions which extend beyond the respective top and bottom surfaces 45 and 47 of the segments. The stakes 52 and 54 are formed of lengths of 0.025 inch square, tinned, bronzed stock or its equivalent.

The top portion 56 (FIG. 2) of bent stake 52 is bent over at an angle of about 90° to the remainder of the stake and is received in slot 50 to provide a free end or top margin 58 spaced adjacent the opening 48. Top margin 58 provides an electrical contact surface above the plane of segment top surface 45. The top portion 60 of headed stake 54 is cold-worked to form a head having a diameter greater than the passageway 46. The headed top portion 60 is received in the slot 50 adjacent the socket 48, with the top surface of headed top portion 60 providing an electrical contact surface, also above the plane of segment top surface 45. The bottom portions 62 of the stakes 52 and 54 are essentially identical and are cut to provide 60 degree points for ease of insertion of the stakes into perforations in a printed circuit board.

Each assembled switch further includes a screw 64 having a head 66 (FIG. 2) and externally threaded shaft 68, with the shaft 68 being threadedly received in socket 48. Screw 64 is a high performance screw such as a No. 1 by 0.160 inch, type "B", tinned self-tapping, steel screw. Head 66 is such as a "CHEESE" head which is cold headed to provide for either a slotted or combination slotted and Phillips drive. Shaft 68 can be fully threaded, or alternatively, can be terminated in a smooth pilot for ease of installation of the screw into the opening 48. Screw 64 is rotatable only under the intentional, positive, rotative action of such as a screw-driver between an engaged position in which the screw and the bottom surface of the head engages against the top portions 56 and 60 of stakes 52 and 54, respectively, so as to make electrical contact between the stakes through the screw head, and a disengaged position in which the screw is rotated free of the stakes to open electrical contact between the stakes. Thus the stakes form poles of the switch and the screw head forms the bridging contact member.

The external threads of shaft 68 cut or form mating threads in the wall of socket 48. The material of body 16 tightly engages the threads of screw 64 so that screw 64 is positively maintained in its last operative position, whatever that may be.

Thus, a vibrational force will not rotate screw 64, only an intentional rotative force applied thereto will rotate screw 64.

When the screw 64 is in the engaged position making contact between the stakes, the top portions of the stakes are clamped between the underside of the screw head 66 and the top of the segment. This clamping force may be as great as desired and is under control of the operator placing the screw in such operative position. This clamping force can be important in preventing contamination of the electrical path formed between the screw head 66 and the top portions of the stakes, the tightly clamped parts effectively resisting the migration of contaminants therebetween. Moreover, because the screw head is rotated against the top portion of the stakes, there is a self-cleaning wiping action between the lower surface of the screw head and the contact surfaces of the stakes which breaks through any covering or removes any contaminants thereon to ensure a good electrical contact having a low resistance.

The assembly of the invention further provides for the division of the assembly 10 in to blocks of smaller numbers of switches. This is obtained by cutting through the connecting webs 34 between segments such as 22 and 24 (FIG. 5), in any manner desired such as with a tool known as side cutters, to separate the body 10 into a block 70 which may comprise three switches and a block 72 which may comprise five switches. Thus, if a particular circuit requires only a certain number of switches, the switch assembly 10 can readily be divided to obtain blocks of desired number of switches. Separation of the segments is facilitated by the voids such as 36 and 38 between segments and cutting through the connecting webs if facilitated by the sloped or beveled faces 74 of the segments above and below the webs 34.

The switch assembly disclosed lends itself readily to automatic fabrication and assembly. The body 16 may be precision injected molded in long strips having as many as 100 individual segments. The bent and headed stakes may be formed automatically on bandoliers and inserted into the passageways, in mass. Formation of the stakes on bandoliers also facilitates selective plating with precious metals such as gold of only the contact surfaces of the top portions or top margins. The use of a Phillips-head screw facilitates the use of automatic screw drivers during insertion of the screws in the openings 48. Formation of blocks of desired numbers of individual switches is obtained simply by cutting through the two connecting webs between a pair of adjacent segments.

The disclosed screw-switch assembly provides blocks of direct replacement switches for DIP-switch assemblies, and thus, no tooling changes are required on existing circuit boards for use of the screw-switch assembly of the invention.

The screw-switches of the invention are vibration proof due to the vibration absorbing properties of the material of body 16, and because of the holding force of the material of body 16 exerted by the mating threads on screw 64. There can be no accidental or unintentional tripping of switches even if a printed circuit board carrying this type of screw-switch assembly is dropped. Only an intentional act can actuate the screw-switch.

The contacts of the disclosed invention can carry both power and logic level currents, which means that not only can the screw-switches of the invention be used to interface between logical elements such as integrated circuits but further can be used in applications where such switches never have been able to be used before such as carrying power to solenoids or coils.

Most important, the discloses screw-switch is more reliable than a DIP-switch in that there are fewer parts to cause problems. The bridging contact member is formed of a self-tapping screw. The bent stake and headed stake each provide a contact surface at one end and are fixed to the printed circuit board at their other ends by such as soldering. The segment body provides alignment of the parts and acts as one part of a clamping mechanism. The simplicity of the screw-switch of the disclosed assembly is in contrast to the multiple elements of a DIP-switch.

It has been determined that if the screws are overtightened in the sockets to strip the threads formed in the socket wall, that the disclosed material exhibits a self-healing characteristic; the screw may be reinserted in the socket or retightened to form new mating threads with substantially no loss in the clamping force which may be obtained between the screw and segment material. It is unknown exactly what the mechanism for this phenomenon is, but it avoids having to replace an entire switch assembly simply because the mating threads of a single screw-switch are stripped.

Modifications and variations of the present invention are possible in light on the above techniques. For example, the exact configuration of the body to provide separable segments may be changed, as may the configuration of the passageways, sockets, stakes and screws. It is, therefore, to be understood that within the scope of the appended claims, the invention may be practiced otherwise than as specifically described.

What is claimed and desired to be secured by Letters Patent of the United States is:

1. A switch assembly comprising:

a body of electrically insulative material molded to provide a strip of integrally formed, joined segments arranged in side-by-side alignment, each segment having a top surface, a bottom surface and two opposed ends, each segment presenting a pair of vertically extending, parallel passageways opening to the top and bottom surfaces, the passageways being spaced apart at a standard distance, and each segment presenting a vertical socket open to the top surface, the sockets of respective segments being arranged adjacent the upper ends of alternating passageways in said adjacent segments, the passageways in adjacent segments being spaced apart at another standard distance;

a pair of conductive stakes in each segment, one stake being inserted in each passageway of said each segment and each stake presenting a top and bottom portion respectively extending beyond the segment top and bottom surfaces, the top portion of each stake being formed to be adjacent and spaced from the socket of that segment to form a pole of a switch so that the top portions of the two stakes inserted in the two passageways of each segment form two spaced poles of a switch; and each segment having a headed screw inserted in said socket and forming a bridging member extending between said two poles, said screw adapted to be rotated between an engaged position in which the screw head makes electrical contact between the poles of said segment to close the switch of that segment and a disengaged position in which the screw head is free of said poles to open the switch of that segment there being two connecting webs between every pair of adjacent segments, one at each end thereof formed about the median horizontal plane of the segments, the connecting webs having a height less than the distance between the segment top and bottom surfaces and a width much less than the distance between the segment ends.

2. The assembly as claimed in claim 1 in which the segment ends above and below the connecting webs are sloped inwardly to facilitate the cutting through of the connecting webs.

3. The assembly as claimed in claim 1 in which each segment is formed to provide a thin portion and a thick portion, the thin and thick portions being alternately arranged in sequential segments and said thick portions being provided with said sockets.

4. The assembly as claimed in claim 1 in which said screws have self-tapping threads and said sockets have smooth walls, the self-tapping threads forming mating threads in said walls when the screws are inserted therein.

5. The assembly as claimed in claim 4 in which the material of the body has a characteristic of self-healing to provide for the re-formation of threads which have been stripped by overtightening of said screw.

6. The assembly as claimed in claim 1 in which there are two types of stakes, one being a bent stake and the other being a headed stake, one headed stake being inserted in the passageway adjacent the socket and one bent stake being inserted in the other passageway.

7. The assembly as claimed in claim 6 in which the top portion of the headed stake is cold worked to form a head of greater diameter than a passageway and the top portion of the bent stake is bent about 90° relative to the remainder of that stake.

8. The assembly as claimed in claim 1 in which each segment includes a slot formed in its top surface from beyond one passageway to beyond the other passageway, and the top portions of said stakes are received in said slot.

9. The assembly as claimed in claim 1 in which the top portion of each stake is plated selectively with a precious metal.

10. A dual-inline-package switch assembly adapted to be connected to printed circuit leads carried on a substrate and spaced apart at standard distances, comprising:

(a) a body of electrically insulative material providing a plurality of spaced apart, like segments arranged in a strip, the segments having lengths greater than their widths and being joined together in side-by-side alignment, each segment having top and bottom surfaces and two opposed ends;

(b) each segment presenting a pair of passageways and an intermediate socket along the length of the segment, the passageways in each segment and in adjacent segments being spaced apart at said standard distances, and the sockets in sequential segments being located adjacent alternating ones of the pair of passageways;

(c) a pair of conductive stakes in said passageways of each segment, said stakes having top and bottom portions respectively extending above and below the top and bottom surfaces of the segment, said top portions being located adjacent said socket to form two spaced poles of a switch and said bottom portions being located for connection to said leads; and (d) a screw in each segment inserted in said socket and having a head forming a bridging member selectively movable relative to said contact ends for opening and closing an electrical circuit between said stakes.

11. The assembly of claim 10 in which there are separable means between individual segments joining said segments one to another constructed and arranged to enable blocks of segments of any desired number to be formed by selective severance of said separable means.

12. The assembly of claim 11 in which said means include connecting webs joining said segments one to another which can be cut through to form said blocks.

13. The assembly of claim 12 in which said connecting webs are integrally together with said segments.

14. The assembly of claim 13 in which there are two connecting webs between every pair of adjacent segments, one web being located at each end of the segments formed substantially at the median horizontal plane thereof, the connecting webs having a height less than the segment height and width less than the segment length.

15. The assembly of claim 14 in which the segment ends above and below the connecting webs are sloped inwardly to facilitate the cutting through of the connecting webs.

16. The assembly of claim 10 in which each segment is formed to provide a thin portion and a thick portion, the thin and thick portions being alternately arranged in sequential segments and said thick portions being provided with said sockets.

17. The assembly of claim 10 in which said screws have self-tapping threads and said sockets have smooth walls, the self-tapping threads forming mating threads in said walls when the screws are inserted therein.

18. The assembly of claim 17 in which the material of the body has a characteristic of self-healing to provide for the reformation of threads which have been stripped by overtightening of said screw.

19. The assembly of claim 10 in which there are two types of stakes, one being a bent stake and the other being a headed stake, one headed stake being inserted in the passageway adjacent the socket and one bent stake being inserted in the other passageway.

20. The assembly of claim 19 in which the top portion of the headed stake is cold worked to form a head of greater diameter than a passageway and the top portion of the bent stake is bent about 90° relative to the remainder of that stake.

21. The assembly of claim 10 in which each segment includes a slot formed in its top surface from beyond one passageway to beyond the other passageway, and the top portions of said stakes are received in said slot.

22. The assembly of claim 10 in which the top portion of each stake is plated selectively with a precious metal.

23. A dual-inline-package switch assembly comprising:

(a) a unitary body of electrically insulative material comprised of a plurality of spaced apart, like segments including separable means only joining the segments one to another in side-by-side alignment, and each segment having a top surface and two opposed ends;

(b) a pair of conductive members in each segment having connection ends extending beyond the segment adapted for connection to a circuit and contact ends opposite said connection ends spaced one from the other to form two poles of a switch;

(c) each segment having a vertical socket opening to said top surface;

(d) an electrically conductive fastener having a threaded shank engaged in said socket and having a head adapted to be selectively moved into and out of engagement with said contact ends for closing and opening an electrical circuit respectively, and (e) there being a pair of such separable means joining each pair of side-by-side segments, said means being located adjacent the said two opposed ends and constructed and arranged to enable selective separation of the unitary body into individual blocks of any desired number of segments.

24. The assembly of claim 23 in which said means consist of connecting webs of insulative material joining the side-by-side segments and enabling such blocks of segments to be formed by cutting through selected connecting webs.

25. The assembly of claim 24 in which each of said webs has a height less than the height of said segments and a width substantially less than the distance between the opposed ends of the segments.

26. The assembly of claim 25 in which each of said webs is formed substantially at the median horizontal plane of the segments.

27. The assembly of claim 23 in which the said contact ends are arranged along the direction of the length of the block in a staggered or alternating formation.

28. The dual-inline-package switch assembly comprising:

(a) a unitary body of electrically insulative material providing a plurality of spaced apart, like segments joined together as an elongated strip in side-by-side alignment, each segment presenting thin and thick portions alternately arranged in sequential segments, each segment having a top surface and two opposed ends;

(b) a pair of conductive members in each segment, the members having connection ends extending beyond the segment adapted for connection to a circuit and having contact ends opposite said connection ends spaced one from another to form two poles of a switch;

(c) each segment presenting a vertical socket in said thick portion opening to the top surface; and (d) a screw inserted in said socket and having a head forming a bridging member arranged to be moved relative to said contact ends for selectively opening and closing an electrical circuit between said pair of members of the associated segment.

29. A switch assembly comprising:

a body of electrically insulative material molded to provide a strip of integrally formed, joined segments arranged in side-by-side alignment, each segment having a top surface, a bottom surface and two opposed ends;

each segment presenting a pair of vertically extending, parallel passageways opening to the top and bottom surfaces, the passageways being spaced apart at a standard distance, and each segment presenting a vertical socket open to the top surface, the sockets of respective segments being arranged adjacent the upper ends of alternating passageways in said adjacent segments, the passageways in adjacent segments being spaced apart at another standard distance;

a pair of conductive stakes in each segment, one stake being inserted in each passageway of said each segment and each stake presenting a top and bottom portion respectively extending beyond the segment top and bottom surfaces, the top portion of each stake being formed to be adjacent and spaced from the socket of that segment to form a pole of a switch so that the top portions of the two stakes inserted in the two passageways of each segment form two spaced poles of a switch; and each segment having a headed screw inserted in said socket and forming a bridging member extending between said two poles, said screw adapted to be rotated between an engaged position in which the screw head makes electrical contact between the poles of said segment to close the switch of that segment and a disengaged position in which the screw head is free of said poles to open the switch of that segment, each segment being formed to provide a thin portion and a thick portion, the thin and thick portions being alternately arranged in adjacent segments and said thick portions being provided with said sockets.

30. A switch assembly comprising:

a body of electrically insulative material molded to provide a strip of integrally formed, joined segments arranged in side-by-side alignment, each segment having a top surface, a bottom surface and two opposed ends, each segment presenting a pair of vertically extending, parallel passageways opening to the top and bottom surfaces, the passageways being spaced apart at a standard distance, and each segment presenting a vertical socket open to the top surface, the sockets of respective segments being arranged adjacent the upper ends of alternating passageways in said adjacent segments, the passageways in adjacent segments being spaced apart at another standard distance;

a pair of conductive stakes in each segment, one stake being inserted in each passageway of said each segment and each stake presenting a top and bottom portion respectively extending beyond the segment top and bottom surfaces, the top portion of each stake being formed to be adjacent and spaced from the socket of that segment to form a pole of a switch so that the top portions of the two stakes inserted in the two passageways of each segment form two spaced poles of a switch; and each segment having a headed screw inserted in said socket and forming a bridging member extending between said two poles, said screw adapted to be rotated between an engaged position in which the screw head makes electrical contact between the poles of said segment to close the switch of that segment and a disengaged position in which the screw head is free of said poles to open the switch of that segment, there being two types of stakes, one type being a bent stake and the other being a headed stake, one headed stake being inserted in the passageway of a segment adjacent the socket and one bent stake being inserted in the other passageway of that segment.

* * * * *